US007708953B2

(12) United States Patent
Cremeens et al.

(10) Patent No.: US 7,708,953 B2
(45) Date of Patent: May 4, 2010

(54) APPARATUS AND SYSTEM FOR ENSURING PROPER ASSEMBLY OF AN EXHAUST SYSTEM

(75) Inventors: Chris Cremeens, Madison, WI (US); Jeff Sedlacek, Stoughton, WI (US)

(73) Assignee: Cummins Filtration IP, Inc., Minneapolis, MN (US)

( * ) Notice: Subject to any disclaimer, the term of this patent is extended or adjusted under 35 U.S.C. 154(b) by 983 days.

(21) Appl. No.: 11/329,774

(22) Filed: Jan. 11, 2006

(65) Prior Publication Data

US 2007/0157467 A1 Jul. 12, 2007

(51) Int. Cl.
*B01D 50/00* (2006.01)

(52) U.S. Cl. ..... 422/168

(58) Field of Classification Search ..... 422/168, 422/177, 180; 285/23, 253; 277/598, 609
See application file for complete search history.

(56) References Cited

U.S. PATENT DOCUMENTS 5,176,406 A 1/1993 Straghan
6,578,851 B1 * 6/2003 Bryant, III ..... 277/598
2003/0039595 A1 * 2/2003 Geise ..... 422/168
2005/0099001 A1 * 5/2005 Cassel et al. ..... 285/23
2007/0039316 A1 2/2007 Bosanec, Jr. et al.

OTHER PUBLICATIONS

PCT/US2008/054949, International Search Report and Written Opinion, Jun. 3, 2009.

* cited by examiner

*Primary Examiner*—Tom Duong
(74) *Attorney, Agent, or Firm*—Kunzler Needham Massey & Thorpe

(57) ABSTRACT

An apparatus and system are disclosed for ensuring proper assembly of an exhaust system. Ensuring proper assembly of an exhaust system is accomplished by providing an inflow exhaust subassembly for receiving engine exhaust, at least one intermediate subassembly that selectively mates and rotationally aligns with the inflow subassembly and receives engine exhaust therefrom, the at least one intermediate subassembly further configured to selectively mate according to a pre-selected alignment with an outflow subassembly, and the outflow subassembly configured to receive engine exhaust from the at least one intermediate subassembly. In certain embodiments, the at least one intermediate subassembly comprises a plurality of intermediate exhaust subassemblies each configured to selectively mate with adjacent subassemblies according to a pre-selected order and alignment.

19 Claims, 5 Drawing Sheets

APPARATUS AND SYSTEM FOR ENSURING PROPER ASSEMBLY OF AN EXHAUST SYSTEM

BACKGROUND OF THE INVENTION

1. Field of the Invention

This invention relates to exhaust treatment systems and more particularly relates to apparatus, systems, and methods for ensuring proper assembly of an exhaust system.

2. Description of the Related Art

Engine performance is becoming increasingly important under a growing demand for safe, reliable, and environmentally friendly transportation. Pursuant to achieving safe, reliable, and environmentally friendly transportation, is the implementation of effective exhaust treatment systems. Properly assembling exhaust treatment systems is a necessary component to providing effective exhaust treatment systems.

FIG. 1 is a perspective view on a prior art exhaust treatment system 100. The depicted system 100 includes an inflow subassembly 140, a first intermediate subassembly 130, a second intermediate subassembly 120, an outflow subassembly 110, a set of subassembly fasteners 160. The system 100 also includes a pressure sensing member 150 for sensing the pressure in the inflow subassembly 110 and the second intermediate subassembly 130.

The performance of the exhaust treatment system 100 is dependent upon proper ordering (or sequencing) and rotational alignment of the various subassemblies 110, 120, 130, and 140. For example, in an embodiment where the first intermediate subassembly 130 is a catalytic converter and a second intermediate subassembly 120 is a filter, erroneously placing the filter 120 before the catalytic converter 130 would render the exhaust treatment system 100 useless from an emissions control standpoint. Also, as the pressure sensor 150 is substantially linear in shape and enters both the outflow subassembly 110 and the first intermediate subassembly 130 at openings that are similarly rotationally aligned. Accordingly, the outflow subassembly 110 and first intermediate subassembly 130 must be properly aligned for the pressure sensor to be able to properly enter the subassemblies 110, 130. In a scenario wherein the various subassemblies 110, 120, 130, and 140, are improperly ordered or aligned, the effectiveness of the exhaust treatment system 100 is forfeited.

From the foregoing discussion, it should be apparent that a need exists for an apparatus and system for ensuring proper assembly of exhaust treatment systems. Beneficially, such an apparatus and system would ensure proper assembly of exhaust subassemblies by requiring proper subassembly ordering and alignment.

SUMMARY OF THE INVENTION

The present invention has been developed in response to the present state of the art, and in particular, in response to the problems and needs in the art that have not yet been fully solved by currently available solutions. Accordingly, the present invention has been developed to provide an apparatus and system for ensuring proper assembly of an exhaust system that overcome many or all of the above-discussed shortcomings in the art.

In a first aspect of the invention, an apparatus for ensuring proper assembly of an exhaust system includes an exhaust treatment unit that receives exhaust from an upstream unit and provides exhaust to a downstream unit. The exhaust treatment unit includes a first mating perimeter that mates with a mating perimeter of an upstream unit. The exhaust treatment unit further includes a second mating perimeter that mates with a mating perimeter of a downstream unit. At least one mating perimeter of the first and second mating perimeters comprises a docking element sized, shaped, and placed to mate with a docking element of a particular exhaust treatment unit and thereby selectively mate and rotationally align the exhaust treatment unit with a particular exhaust treatment unit.

In certain embodiments, the first and second mating perimeters each comprise a docking element. In one embodiment, one docking element is a recess that selectively receives a projection from a particular subassembly unit and the other docking element is a projection that selectively mates with a recess of a particular subassembly unit. The exhaust treatment unit may be one of a variety of subassembly units that perform a specific function such as a catalyst subassembly and a filter subassembly. The apparatus may also include a gasket to facilitate mating of the exhaust treatment unit with the at least one other exhaust subassembly unit.

A system of the present invention is also presented for proper assembly of exhaust subassemblies. The system may include an inflow subassembly that receives engine exhaust, at least one intermediate subassembly that selectively mates and rotationally aligns with the inflow subassembly and receives engine exhaust therefrom. Also, the at least one intermediate subassembly selectively mates and rotationally aligns with an outflow subassembly. The outflow subassembly receives engine exhaust from the at least one intermediate subassembly.

In certain embodiments, the at least one intermediate subassembly is a plurality of intermediate exhaust subassemblies that each selectively mate and rotationally align with adjacent subassemblies. In certain embodiments, the at least one intermediate subassembly includes a recess that selectively receives a projection from the inflow subassembly. In such embodiments, the at least one intermediate subassembly may also include a projection configured to selectively mate with a recess of the outflow subassembly. In other embodiments, the at least one intermediate subassembly includes a recess that selectively receives a projection from the outflow subassembly. In such embodiments, the at least one intermediate subassembly may also include a projection configured to selectively mate with a recess of the inflow subassembly.

The various embodiments of the present invention provide corresponding features and advantages. Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Figure 1:
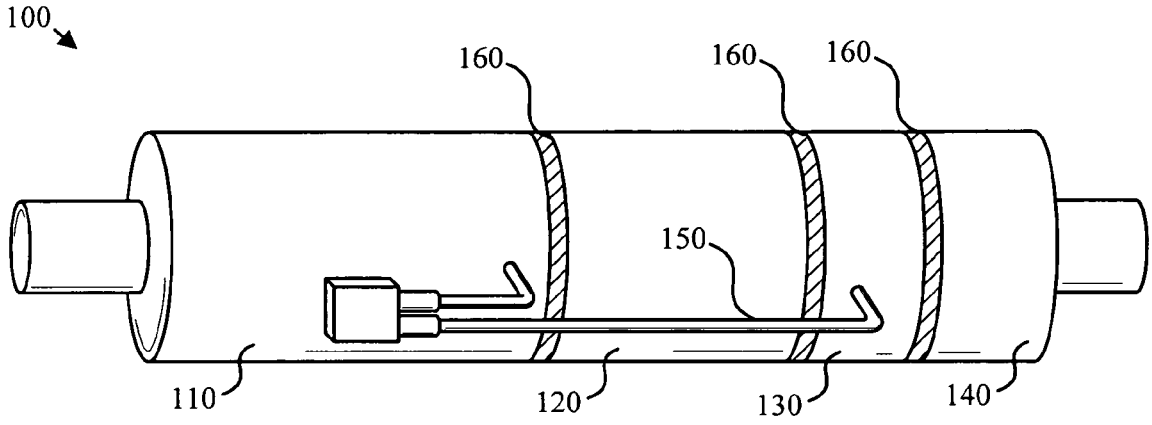
FIG. 1 is a perspective view of one embodiment of a prior art exhaust treatment system.
Figure 2:
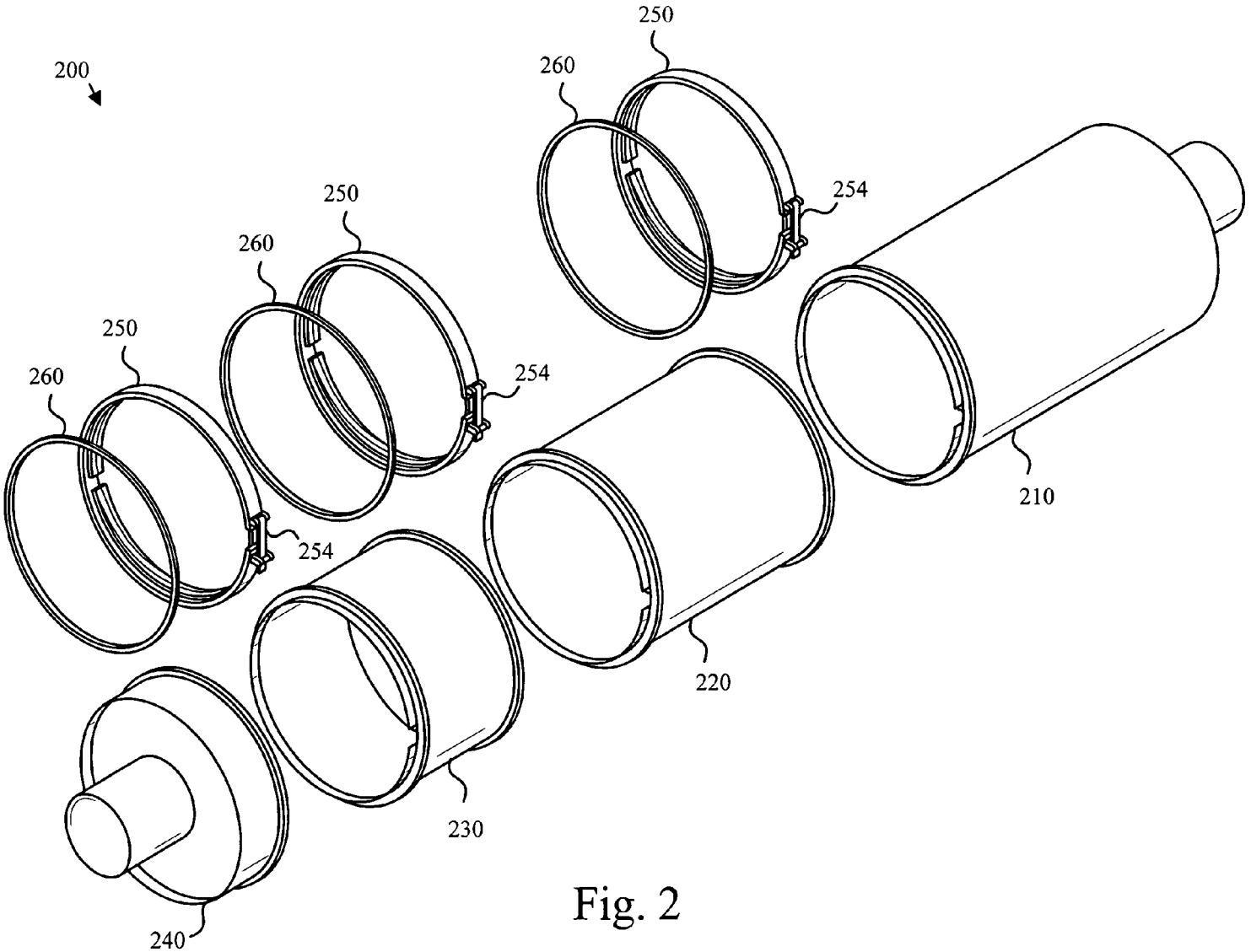
FIG. 2 is a perspective view of one embodiment of an exhaust treatment system in accordance with the present invention.

FIG. 2 is a perspective view of one embodiment of an exhaust treatment system 200 in accordance with the present invention. The depicted system 200 includes an inflow subassembly 240, a first intermediate subassembly 230, a second intermediate subassembly 220, an outflow subassembly 210, subassembly gaskets 260, and subassembly fasteners 250. In certain embodiments, the system 200 may also include a pressure sensing member similar to the pressure sensing member 150 of FIG. 1. The various components of the system 200 ensure proper assembly of the subassemblies 210, 220, 230, 240 according to a pre-selected subassembly order (or sequence) and rotational alignment. When fully assembled, in certain embodiments, the exhaust treatment system 200 appears substantially similar to the system of FIG. 1.

The inflow subassembly 240 receives engine exhaust. The first intermediate subassembly selectively mates and rotationally aligns with the inflow subassembly 240 and receives exhaust therefrom. Similarly, the second intermediate subassembly 220 selectively mates and rotationally aligns with the first intermediate subassembly 230 and receives exhaust therefrom. Also, the outflow subassembly 210 selectively mates with the second intermediate subassembly 220 according to a pre-selected alignment and receives exhaust therefrom.

Figure 3:
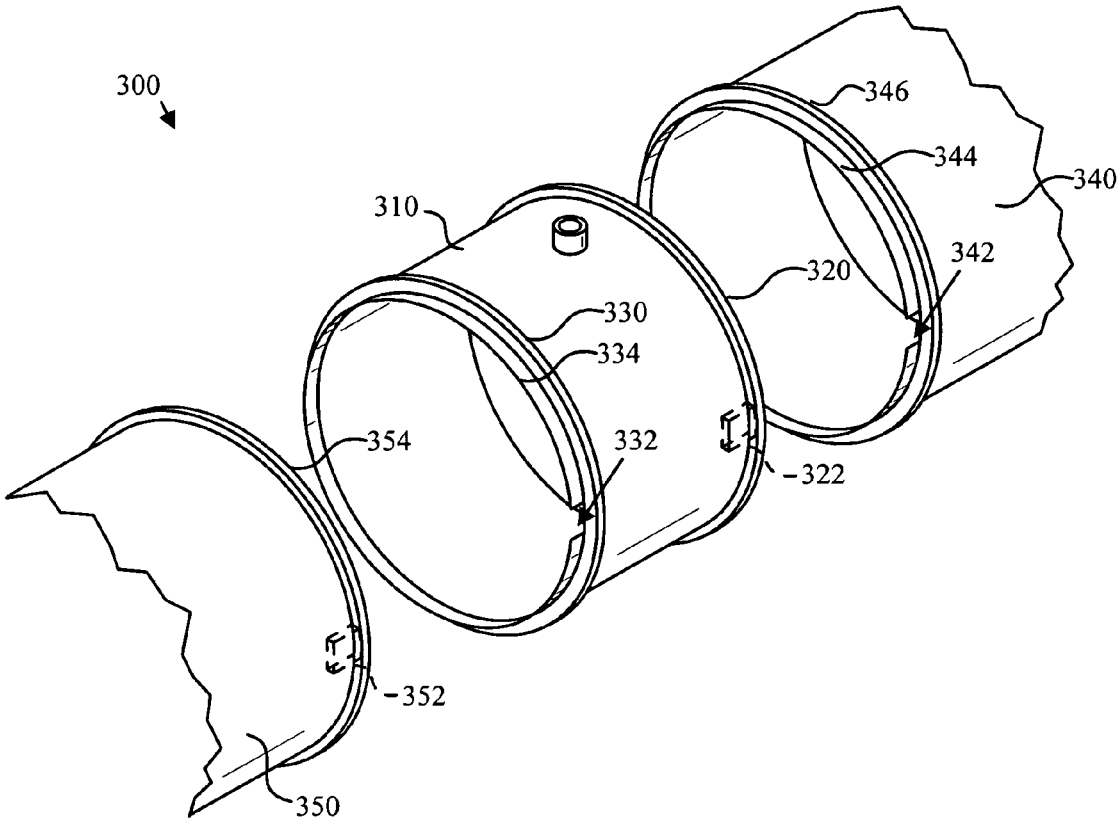
FIG. 3 is a perspective view of one embodiment of an exhaust treatment subassembly in accordance with the present invention.
Figure 4:
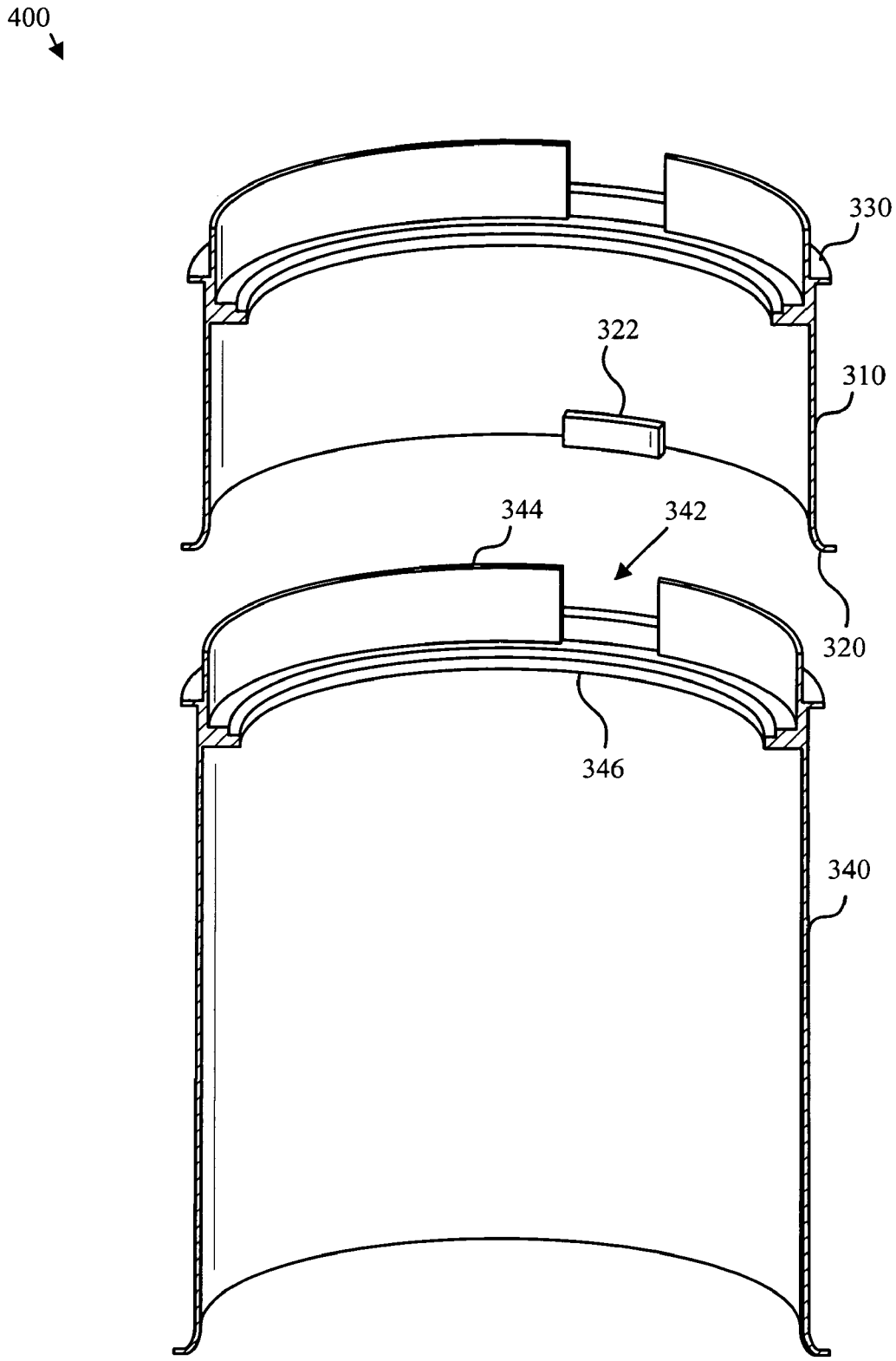
FIG. 4 is a cross sectional view of one embodiment of an exhaust treatment subassembly in accordance with the present invention.
Figure 5:
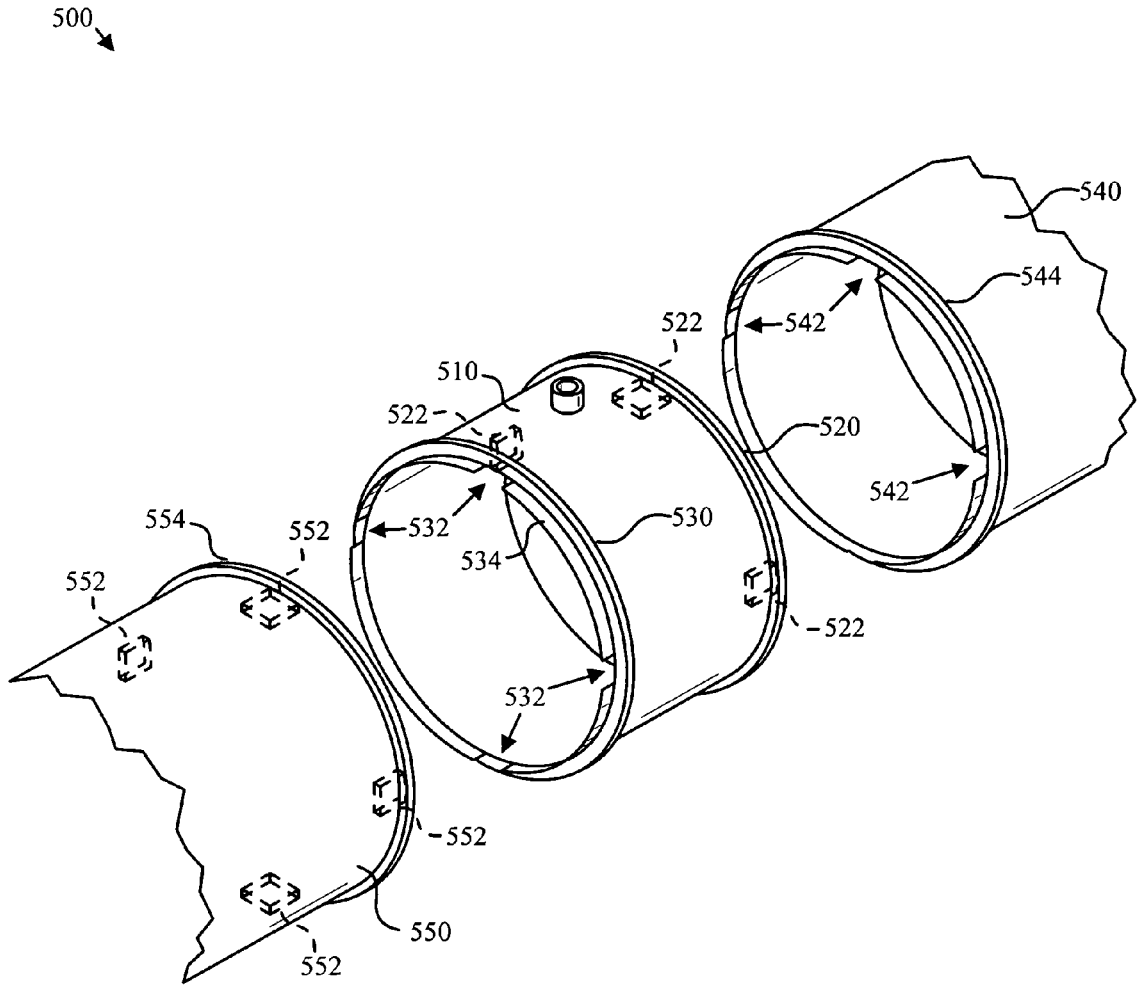
FIG. 5 is a perspective view of one embodiment of an exhaust treatment subassembly in accordance with the present invention.

As further taught in FIGS. 3, 4, and 5, in certain embodiments, the subassemblies 210, 220, 230, and 240 ensure proper assembly via a docking element (such as a projection or recess) sized, shaped, and positioned to mate with a docking element (such as a corresponding recess or projection) of a specific, adjacent subassembly. Before the subassemblies 210, 220, 230, 240 are mated, a gasket 260 may be positioned at the mating point of each subassembly 210, 220, 230, 240 so as to ensure no gaseous leakage will occur. Once the subassemblies 210, 220, 230, 240 are mated and the gasket 260 is in place, a fastener 250 or similar device may be place over each gasket and fasten the mating of each subassembly 210, 220, 230, 240 (see FIG. 1). In the depicted embodiment, each fastener 250 includes a clamping member 254 that tightens the fastener 250 over the perimeter of adjoining subassemblies.

FIG. 3 is a perspective view of one embodiment of an exhaust treatment subassembly 300 in accordance with the present invention. The depicted subassembly 300 includes an exhaust treatment unit 310, a first mating perimeter 320, a projection 322, a second mating perimeter 330, a recess 332, and a recess rim 334. The various components of the exhaust treatment subassembly 300 ensure proper assembly by requiring selective mating according to a pre-selected subassembly order and rotational alignment with adjacent subassemblies 340, 350.

When mated, the exhaust treatment unit 310 receives exhaust from an upstream unit 340 and provides exhaust to a downstream unit 350. The exhaust treatment unit 310 may include a variety of exhaust treatment subassemblies such as a catalytic converter or a filter. Accordingly, a particular emissions functionality of the exhaust treatment unit 310 is not a necessary aspect of the present invention.

The first mating perimeter 320 selectively mates with an upstream mating perimeter 346 of the upstream exhaust treatment subassembly 340. In the depicted embodiment, the first mating perimeter 320 includes a docking element in the form of a projection 322 and the upstream mating perimeter 346 includes a docking element in the form of an upstream recess 342 and upstream recess rim 344. The upstream recess 342 is specifically sized, shaped, and placed to receive the projection 322 of the exhaust treatment unit 310 as opposed to the projection 352 of the downstream exhaust treatment unit 350.

Similarly, the second mating perimeter 330 of the exhaust treatment unit 310 mates with a downstream mating perimeter 354 of the downstream exhaust treatment unit 350. The depicted second mating perimeter 330 includes docking element in the form of a recess 332 and a recess rim 334. The recess 332 is specifically sized to receive the down stream projection 352, similar to the projection 322 and upstream recess 342. Accordingly, the size of the projections 322, 352 and recesses 332, 342 function to ensure selective mating and rotational alignment of the subassemblies 310, 340, 350. In an embodiment involving multiple subassemblies, each subassembly may implement a similar strategy to ensure proper assembly of each subassembly in the entire exhaust treatment system 200 (see FIG. 2).

As the mating between the first mating perimeter 320 and upstream mating perimeter 346 and mating between the second mating perimeter 330 and the downstream mating perimeter 354 are substantially similar in the depicted embodiment, the following will disclose, teach, and enable the mating between the first mating perimeter 320 and upstream mating perimeter 346 and thereby inferentially disclose, teach, and enable the mating between the second mating perimeter 330 and the downstream mating perimeter 354.

Accordingly, once the projection 322 is received by the upstream recess 342, the upstream recess rim 344 impedes rotation of the two exhaust treatment units 310, 340 as the received projection 322 is in contact with the upstream rim 344. Accordingly, the specifically sized, shaped, and placed projection 322 and corresponding upstream recess 342 ensure proper mating and rotational alignment, as another subassembly with an overly large projection will not fit into the upstream recess 342 and another subassembly with a projection that is too small will allow a slight rotation of the subassemblies indicating an improper order or sequencing of subassemblies.

In certain embodiments, the shape of the projection 322 and corresponding upstream recess 342 may be substantially triangular, octagonal, etc, as opposed to substantially rectangular as depicted. Accordingly, the size, shape, and placement of the docking elements (i.e. projection 322 and recess 342) need not be specific, so long as the size, shape, and placement ensure selective subassembly mating and rotational alignment.

FIG. 4 is a cross-sectional view of one embodiment of an exhaust treatment subassembly 400 in accordance with the present invention. The depicted subassembly 400 includes an exhaust treatment unit 310 with a first mating perimeter 320 and a second mating perimeter 330. The cross sectional view of the subassembly shown in FIG. 3 is presented to highlight particular details of one embodiment of the present invention.

Accordingly, the projection 322 is received by a specifically sized, shaped, and positioned, upstream recess 342. The recess 342 is a space created by an upstream recess rim 344 that rotationally aligns and selectively mates the exhaust treatment units 310, 340, as only the projection 322 may properly fit into the upstream recess 342 as opposed to the projection of another exhaust treatment unit (see FIG. 2).

In the depicted embodiment, the both the projection 322 and the recess 342 are substantially rectangular in shape and complementary in size. Selective mating, proper ordering or sequencing is achieved as only the projection 322 will properly fit into the recess 342. All other projections will have a different size, shape, or position. Rotational alignment is achieved as the first mating perimeter 320 and the upstream mating perimeter 346 can only mate if the projection 322 is fitted within the recess 342. Accordingly, the present invention ensures proper assembly of an exhaust system by requiring selective mating and rotational alignment of the subassemblies within the system.

FIG. 5 is a perspective view of one embodiment of an exhaust treatment subassembly 500 in accordance with the present invention. Contrasting the subassembly illustrated in FIGS. 3 and 4, the depicted subassembly 500 teaches an embodiment with a plurality of projections 522 and recess 552. Accordingly, the illustrated embodiment is only one of many possible embodiments that ensure proper assembly of exhaust treatment subassemblies via selective mating and rotational aligning.

Similar to the subassembly of FIG. 3, the first mating perimeter 520 of the exhaust treatment unit 510 mates with a mating perimeter 544 of an upstream unit 540. Also, the second mating perimeter 530 of the exhaust treatment unit 510 mates with the mating perimeter 554 of a downstream unit 550. However, unlike the subassembly of FIG. 3, the depicted subassembly 500 illustrates first and second docking element in the form of a first set of projections 522 and second set of recess 532, respectively.

The three projections 522 of the exhaust treatment unit 510 particularly correspond in size, shape, placement, and number to the three upstream recesses 542 of the upstream exhaust treatment unit 540. Similarly, the four recesses 532 of the exhaust treatment unit 510 particularly correspond in size, shape, placement, and number to the four downstream projections 552 of the down stream exhaust treatment unit 550. Accordingly, during assembly, the downstream exhaust treatment unit 550 cannot be erroneously ordered or sequenced next to the upstream exhaust treatment unit 540 as the downstream exhaust treatment unit 550 requires four recesses but the upstream exhaust treatment unit 540 only provides three recesses 542.

In certain embodiments, the number and size of projections 522, 552 may vary. In other embodiments, the exhaust treatment unit 510 provides docking elements of different styles. For example, one docking element may include a set of projections 522 that correspond to upstream recesses 542 on one side of the exhaust treatment unit 510 (as depicted), and the other docking element may include a serrated edge that corresponds the serrated edge of a downstream exhaust treatment unit (not shown). Accordingly, an exhaust treatment unit having docking elements of different styles may adequately accomplish the task of ensuring proper assembly of the exhaust treatment system via selective mating and mandatory rotational alignment. In other words, the docking elements need not be type or style specific to accomplish the general task of ensuring proper assembly of exhaust treatment systems.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus for ensuring proper assembly of an exhaust system, the apparatus comprising:

a first exhaust treatment unit communicable in exhaust flowing communication with a second exhaust treatment unit, each of the first and second exhaust treatment units comprising an interior surface and opposing exterior surface;

wherein the first exhaust treatment unit comprises a mating perimeter configured to mate with a mating perimeter of the second exhaust treatment unit;

wherein the mating perimeter of the first exhaust treatment unit comprises a recess formed in a rim extending from the mating perimeter of the first exhaust treatment unit, the recess being positioned about only a portion of the mating perimeter, the recess having a first size and shape, and being positioned at a first circumferential location of the mating perimeter of the first exhaust treatment unit;

wherein the recess is configured to matingly engage a projection of the mating perimeter of the second exhaust treatment unit, the projection being positioned about only a portion of the mating perimeter of the second exhaust treatment unit, the projection having a second size and shape corresponding to the first size and shape, the projection being positioned at a second circumferential location of the mating perimeter of the second exhaust treatment unit, the second circumferential location corresponding to the first circumferential location of the mating perimeter of the first exhaust treatment unit, and the projection protruding inwardly from the interior surface of the first exhaust treatment unit;

wherein when the first and second exhaust treatment units are matingly engaged, the recess and rim are positioned within the second exhaust treatment unit, the projection is positioned within the recess, and the recess and projection contact each other to prevent relative rotation between the first and second exhaust treatment units;

wherein the apparatus further comprises a gasket configured to seal the mating perimeters of the first and second exhaust treatment units; and wherein the apparatus further comprises a fastener positioned about the mating perimeters and the gasket.

2. The apparatus of claim 1, wherein the mating perimeter of the first exhaust treatment unit comprises a first mating perimeter, the first exhaust treatment unit further comprising a second mating perimeter configured to mate with a mating perimeter of a third exhaust treatment unit, the second mating perimeter comprising a projection having one of a different shape, different circumferential location, and different size than the recess of the first mating perimeter.

3. The apparatus of claim 2, wherein the projection of the second mating perimeter is sized and shaped to mate with a corresponding recess in the mating perimeter of the third exhaust treatment unit.

4. The apparatus of claim 1, wherein the first and second exhaust treatment units are selected from the group consisting of a catalytic treatment unit and a filter.

5. A system for ensuring proper assembly of an exhaust system, the system comprising:

an inflow subassembly configured to receive engine exhaust, the inflow subassembly comprising a mating perimeter having one of a first recess and first projection each having a first size, first shape, and first location;

at least one intermediate subassembly configured to selectively mate and rotationally align with the inflow subassembly and receive engine exhaust therefrom, the at least one intermediate subassembly comprising a first mating perimeter having the other of the first recess and first projection, the first recess being configured to matingly engage the first projection;

the at least one intermediate subassembly further configured to selectively mate and rotationally align with an outflow subassembly, the at least one intermediate subassembly comprising a second mating perimeter having one of a second recess and second projection each having a second size, second shape, and second location, wherein at least one of the first size is different than the second size, the first shape is different than the second shape, and the first location is different than the second location;

the outflow subassembly configured to receive engine exhaust from the at least one intermediate subassembly, the outflow subassembly comprising a mating perimeter having the other of the second recess and second projection, the second recess being configured to matingly engage the second projection; and a first gasket configured to seal the mating perimeter of the inflow subassembly and the first mating perimeter of the at least one intermediate subassembly;

a second gasket configured to seal the mating perimeter of the outflow subassembly and the second mating perimeter of the at least one intermediate subassembly;

a first fastener positioned about the first gasket, mating perimeter of the inflow subassembly, and first mating perimeter of the at least one intermediate subassembly; and a second fastener positioned about the second gasket, mating perimeter of the outflow subassembly, and second mating perimeter of the at least one intermediate subassembly;

wherein the first and second projections protrude inwardly from an interior surface of the corresponding subassembly.

6. The system of claim 5, wherein the at least one intermediate subassembly comprises a plurality of intermediate subassemblies each configured to selectively mate and rotationally align with adjacent subassemblies.

7. The system of claim 5, wherein the first and second recesses each comprise a slot formed in a rim.

8. The system of claim 5, wherein the first and second projections each protrude from an interior surface of the respective subassemblies.

9. The system of claim 5, wherein each of the first and second recesses extend between an exterior surface and an interior surface of respective subassemblies.

10. The system of claim 5, wherein mating engagement between the first recess and projection rotationally aligns the inflow subassembly and the at least one intermediate subassembly, mating engagement between the second recess and projection rotationally aligns the outflow subassembly and the at least one intermediate subassembly, and mating engagement between the first recess and projection and mating engagement between the second recess and projection ensures the inflow, intermediate, and outflow subassemblies are in a predetermined order relative to each other.

11. The system of claim 5, wherein the at least one intermediate subassembly is selected from the group consisting of a catalyst subassembly and a filter subassembly.

12. The system of claim 5, further comprising a first gasket configured to facilitate mating of the inflow subassembly with the at least one intermediate subassembly and a second gasket configured to facilitate mating of the at least one intermediate subassembly with the outflow subassembly.

13. The system of claim 5, wherein:

the inflow subassembly comprises an exhaust treatment device of a first type and the outflow subassembly comprises an exhaust treatment device of a second type; for proper operation of the exhaust system, the first type of exhaust treatment device must be upstream of the second type of exhaust treatment device; and the first size, first shape, and first location of the first recess and projection correspond only with exhaust treatment devices of the first type, and the second size, second shape, and second location of the second recess and projection correspond only with exhaust treatment devices of the second type.

14. A system for ensuring proper assembly of an exhaust system, the system comprising:

an inflow subassembly configured to receive engine exhaust, the inflow subassembly comprising a mating perimeter having a projection;

at least one intermediate subassembly configured to selectively mate and rotationally align with the inflow subassembly and receive engine exhaust therefrom;

the at least one intermediate subassembly further configured to selectively mate and rotationally align with an outflow subassembly, wherein the at least one intermediate subassembly comprises a first mating perimeter having a first docking element and a second mating perimeter having a second docking element;

the outflow subassembly configured to receive engine exhaust from the at least one intermediate subassembly, the outflow subassembly comprising a mating perimeter having a recess; and a first gasket configured to seal the mating perimeter of the inflow subassembly and the first mating perimeter of the at least one intermediate subassembly;

a second gasket configured to seal the mating perimeter of the outflow subassembly and the second mating perimeter of the at least one intermediate subassembly;

a first fastener positioned about the first gasket, mating perimeter of the inflow subassembly, and first mating perimeter of the at least one intermediate subassembly; and a second fastener positioned about the second gasket, mating perimeter of the outflow subassembly, and second mating perimeter of the at least one intermediate subassembly;

wherein the first docking element comprises a recess configured to selectively mate with the projection of the inflow subassembly and thereby rotationally align the inflow subassembly and the at least one intermediate subassembly, and the second docking element comprises a projection configured to selectively mate with the recess of the outflow subassembly and thereby rotationally align the outflow subassembly and the at least one intermediate subassembly;

wherein the projection of the inflow subassembly is not mateable with the recess of the outflow subassembly; and wherein the projection of the inflow subassembly protrudes inwardly from an interior surface of the inflow subassembly, and the projection of the at least one intermediate subassembly protrudes inwardly from an interior surface of the at least one intermediate subassembly.

15. The system of claim 14, wherein the at least one intermediate subassembly comprises a plurality of intermediate subassemblies each configured to selectively mate and rotationally align with adjacent subassemblies.

16. The system of claim 14, wherein the at least one intermediate subassemblies is selected from the group consisting of a catalyst subassembly and a filter subassembly.

17. The system of claim 14, further comprising a first gasket configured to facilitate mating of the inflow subassembly with the at least one intermediate subassembly and a second gasket configured to facilitate mating of the at least one intermediate subassembly with the outflow subassembly.

18. The system of claim 14, wherein the at least one intermediate subassembly comprises a plurality of recesses configured to selectively mate with a plurality of projections of the inflow subassembly, wherein the at least one intermediate subassembly comprises a plurality of projections configured to selectively mate with a plurality of recesses of the outflow subassembly, and wherein the plurality of projections of the inflow subassembly are not mateable with the plurality of recesses of the outflow subassembly.

19. The system of claim 5, wherein the inflow subassembly comprises a plurality of one of first recesses and first projections, the at least one intermediate subassembly comprising a plurality of the other of the first recesses and first projections, wherein the at least one intermediate subassembly further comprises a plurality of one of second recesses and second projections, the outflow subassembly comprising a plurality of the other of the second recesses and second projections.

* * * * *